US007318290B2

(12) United States Patent
Jones et al.

(10) Patent No.: US 7,318,290 B2
(45) **Date of Patent: *Jan. 15, 2008**

(54) FOOTWEAR WITH REVERSIBLE TONGUE

(75) Inventors: Lindell B. Jones, Chesterfield, MO (US); Raymond F. Tonkel, Sudbury, MA (US)

(73) Assignee: U Turn Sports Co., LLC., Chesterfield, MO (US)

( * ) Notice: Subject to any disclaimer, the term of this patent is extended or adjusted under 35 U.S.C. 154(b) by 333 days.

This patent is subject to a terminal disclaimer.

(21) Appl. No.: 10/780,168

(22) Filed: Feb. 17, 2004

(65) Prior Publication Data

US 2004/0187351 A1 Sep. 30, 2004

Related U.S. Application Data

(63) Continuation-in-part of application No. 10/222,313, filed on Aug. 15, 2002, now abandoned, which is a continuation-in-part of application No. 10/122,995, filed on Apr. 11, 2002, now Pat. No. 6,574,887, which is a continuation-in-part of application No. 10/437,140, filed on May 13, 2003, now abandoned.

(60) Provisional application No. 60/285,693, filed on Apr. 24, 2001.

(51) Int. Cl.

| | |
|---|---|
| ***A43B 23/26*** | (2006.01) |
| ***A43B 3/24*** | (2006.01) |
| ***A43B 5/00*** | (2006.01) |
| *A43B 23/00* | (2006.01) |
| *A04B 3/12* | (2006.01) |

(52) U.S. Cl. ..... 36/54; 36/50.1; 36/136; 36/100

(58) Field of Classification Search ..... 36/99, 36/100, 101, 114, 115, 116, 117.1, 118.2, 36/128, 126, 132, 136, 9 R, 54, 50.1
See application file for complete search history.

(56) References Cited

U.S. PATENT DOCUMENTS

| | | | | |
|---|---|---|---|---|
| 1,844,997 A | | 2/1932 | Weigle | |
| 2,049,347 A | | 7/1936 | Benjamin | |
| 3,631,613 A | | 1/1972 | Brettell | |
| 4,372,060 A | | 2/1983 | Adamik | |
| 4,630,383 A | | 12/1986 | Gamm | |
| 4,805,321 A | | 2/1989 | Tonkel | |
| D302,838 S | * | 8/1989 | Wendt | D2/916 |
| 5,094,016 A | | 3/1992 | Divito | |
| 5,177,882 A | * | 1/1993 | Berger | 36/54 |
| 5,311,679 A | | 5/1994 | Birch, Sr. | |
| 5,379,529 A | | 1/1995 | Smith et al. | |
| 5,410,822 A | | 5/1995 | Vaccari | |

(Continued)

*Primary Examiner*—Anthony Stashick
(74) *Attorney, Agent, or Firm*—Paul M. Denk

(57) ABSTRACT

Footwear, incorporating a reversible a tongue, wherein one side or the other of the tongue may be adhered to the upper central vamp portion of the shoe, to display that side during wearing of the shoe, and can be turned to provide a variation in the styling of the shoe. The tongue may further contain a pouch or pocket, secured by any type of fastening device such as Velcro that allows ready access into the tongue, for deposit or removal of personal items. One or more of the surfaces of the formed pocket, in the tongue, may be formed of a transparent or clear material, to allow any personal item deposited therein to be readily viewed.

11 Claims, 10 Drawing Sheets

U.S. PATENT DOCUMENTS 5,459,947 A 10/1995 Lasher
5,659,979 A 8/1997 Sileo
5,673,499 A 10/1997 Attilieni
6,094,841 A 8/2000 Adams
6,212,797 B1 4/2001 Merry et al.
6,321,466 B1 11/2001 Bordin et al.
6,397,497 B1 6/2002 McAtee
6,574,887 B2 * 6/2003 Jones et al. ..... 36/54
2002/0029494 A1 3/2002 Small

* cited by examiner

FOOTWEAR WITH REVERSIBLE TONGUE

CROSS REFERENCE TO RELATED APPLICATION

This application is a continuation-in-part of the patent application having Ser. No. 10/222,313, which was filed on Aug. 15, 2002 now abandoned, which is a continuation-in-part of patent application of the same inventors, having Ser. No. 10/122,995, filed on Apr. 11, 2002, now U.S. Pat. No. 6,574,887, said patent being related to its provisional application having Ser. No. 60/285,693, filed on Apr. 24, 2001; and this current application is a continuation-in-part of patent application having Ser. No. 10/437,140, which was filed on May 13, 2003 now abandoned.

BACKGROUND OF THE INVENTION

This invention relates generally to footwear, and more specifically pertains to footwear in general, wherein the tongue or gusset is reversible, to provide a shoe which furnishes differing styles, and utilitarian uses, to the benefit of its wearer.

Obviously, numerous styles of footwear, constructed of various components, for achieving a multitude of purposes, have long been considered in the prior art. Most of these types of innovations have been in the area of running or athletic shoes, which has been substantially in vogue for the past three decades, wherein various styles of modifications to the soles, to make them more resilient, or add to the efficiency of the runner, and various types of modifications to the structure of the shoe itself, such as even adding pockets to the side or within the tongue or gusset of the shoe, have been considered in the prior art. For example, see the patent to Adamik, U.S. Pat. No. 4,372,060, relating to this type of technology, and their modifications.

The current invention seeks further modifications to the structure of footwear, in order to add to the variations on usage of the shoe, enhance it's styling, and enhance the attractiveness of the footwear, by providing alternative uses and applications to various components of the footwear itself.

SUMMARY OF THE INVENTION

This invention contemplates the formation of footwear in general, including the running or athletic shoe type, but the concepts of this invention may be embodied within any type of shoe, as will be readily determined upon reviewing this invention. The footwear includes, but not limited to, the usual style of shoe having a sole, vamp, quarter portions, counter, and a tongue or gusset secured therein. In the preferred embodiment, the gusset will be of a reversible type, where the tongue can be turned to expose one surface, which may have a stylized and attractive surface provided thereon, or the tongue may be reversed, to furnish an entirely different appearance to the shoe, when worn.

This invention can pertain to an athletic shoe, casual and dress shoes, hikers or boots.

Means are provided to accommodate the reversing of the tongue, and to hold it to the upper vamp portion of the shoe, but which can be readily turned, simply upon opening of its fastening feature, or clasp, which normally holds the tongue in position, while the shoe is being worn. In addition, the tongue or gusset may, but not necessarily, include an internal pocket, that may be readily available for opening, preferably along the upper edge of the tongue, and into which personal items, such as a key or coin may be inserted. The tongue will contain closure means, to provide for its secure retention when closed, so as to prevent the loss of such personal items, and assure their safety. The tongue may further be fabricated, on one surface, with a transparent covering, at least approximate its upper edge, and overlying the formed pocket, so that even the contents of the pouch or pocket may be observable, if this is the desire of the wearer.

The concept of this invention is to provide a link between the shoe gusset or tongue, and the upper vamp portion of the shoe, so that the wearer may reverse the tongue, as desired, for revealing other coloration, indicia, or design. It provides versatility to the usage of the shoe. Such a linkage means could comprise a short link of cord, it may be an elastic cord, or perhaps could comprise a swivel clasp, or any type of other form of clasp, having some degree of flexibility, and which may be twisted or turned. In addition, it may include a clasp, formed of two parts that may swivel, and be interconnected between the upper vamp, and the bottom of the shoe gusset, to accommodate such turning motion. Furthermore, the clasp may be separable, through the exertion of some amount of force, so that the gusset may be removed, and another one relocated, to add further dexterity and versatility to the usage of this invention. In order to prevent the unauthorized removal, or the displacement of the gussets, for the shoes, as for example, when displayed for sale, the pulling force required to separate the clasp may be excessive, up to seventy to eighty pounds or more of pressure, or it may only require a slight amount of force, to separate the clasp, at the desire of the manufacturer, the retailer, and even the user, once the shoes are placed in usage. It is also likely that the tongue may be a compound, or more, style of tongue, having a swivel means between each of the sections of the tongue or gusset, to allow for turning, of just segments, of the tongue, along its height.

It is, therefore, a primary object of this invention to provide a reversible tongue for footwear.

Another object of this invention is to provide a reversible tongue that may have different styles of appearance upon either of its surfaces, so that the tongue can be reversed, and completely change the appearance and attractiveness of the shoe, to the interest of the footwear owner. For example, the consumer can coordinate with team colors, fashion trends, and the like.

Still a further object of this invention to provide footwear, in the category of walking shoes, running shoes, loafers, beach shoes, slippers, sandals, casual or dress shoes, boots, hikers, and even athletic shoes, which may comprise either baseball, football, track, soccer, basketball, and any of the variety of other athletic sports that incorporate particular styled shoes, incorporating the reversible tongue of this invention which adds to the versatility of the appearance and usage of the subject footwear.

Still another object of this invention is to provide a novel swivel that can be used for applying the reversible tongue to the upper central portion of the shoe vamp, to stably hold the tongue in place, while the shoe is being worn.

Obviously, another object, in view of the foregoing, may be an athletic shoe with a reversible tongue so that the coloration on one surface of the tongue may be used, for example, for home games, while the opposite side may be of a differing color, for away games.

Another object of this invention is to provide a pocket for the gusset of this type of footwear so that personal items may be safely stored therein.

Still another object of this invention is to provide means for securing personal items of the wearer of the defined shoe, so that safety can be assured even while using the shoe for athletic events, or for running, but prevent the untimely loss of contained items, such as a key or coin, while participating in strenuous activities.

Yet another object of this invention is to provide a transparent covering for a pocketed tongue, for this type of footwear, so that the contained items may be observed therein, while the shoe is worn.

These and other objects may become more apparent to those skilled in the art upon reviewing the summary of this invention and upon undertaking a study of the description of its preferred embodiment, in view of the drawings.

BRIEF DESCRIPTION OF THE DRAWINGS

Referring to the drawings.

DESCRIPTION OF THE PREFERRED EMBODIMENT

Figure 1:
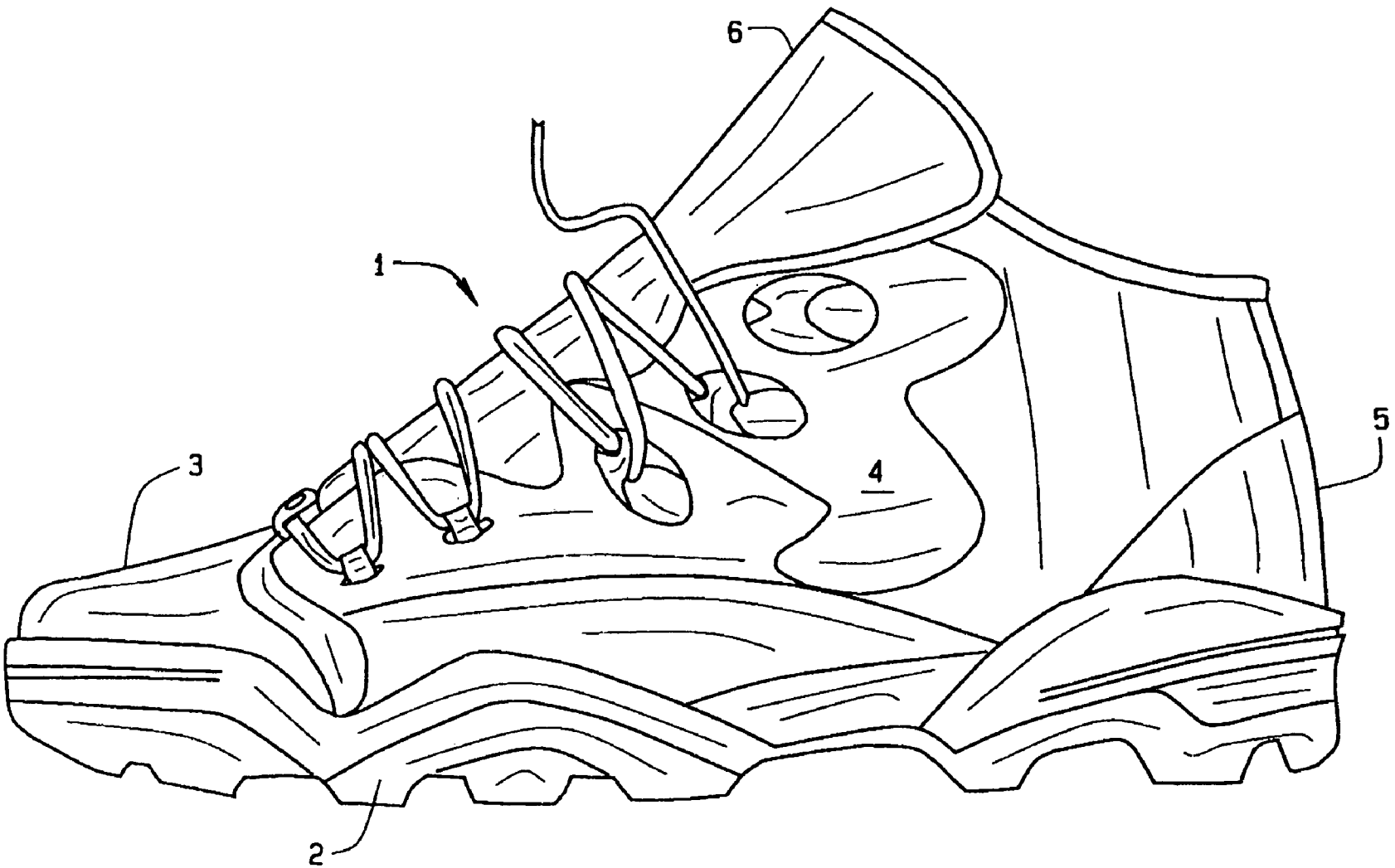
FIG. 1 is a side view of a shoe, such as a running shoe, containing the reversible tongue of this invention.
Figure 2:
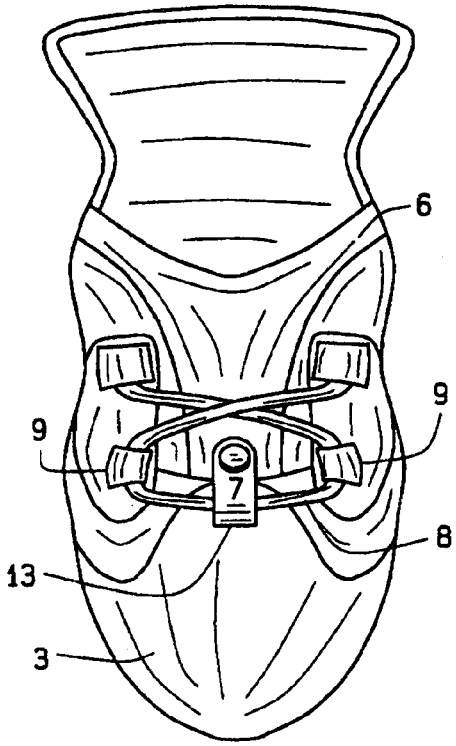
FIG. 2 is a top view of the partial shoe, showing the upper vamp, reversible tongue, clasp holding the tongue to the footwear, and cooperating with lacing to secure the shoe upon the foot of it's wearer.

In referring to the drawings, in particular FIG. 1, a shoe 1 is shown incorporating the usual components including the sole 2, its vamp 3, the quarter portions 4, and a counter 5. Also, as can be noted, the reversible tongue 6 is also disclosed. As can be seen in FIG. 2, the reversible tongue 6 is applied by means of a clasp 7 to the upper central portion of vamp 3, and cooperates to hold the tongue 6 in place, whichever side of the reversible tongue is desired to be exposed upwardly, when the footwear is worn. In addition, the clasp, when holding the tongue in place, cooperates to embrace the lower strand 8 of the shoe string, which further then extends through the various eyelets 9, for lacing the shoe in place upon the foot, as is well known. Obviously, it is not absolutely necessary in this invention to have the string 8 go through the clasp 7, and it need not necessarily do so, for the reversible tongue to be held in position upon the upper edge of the shown vamp.

Figure 3:
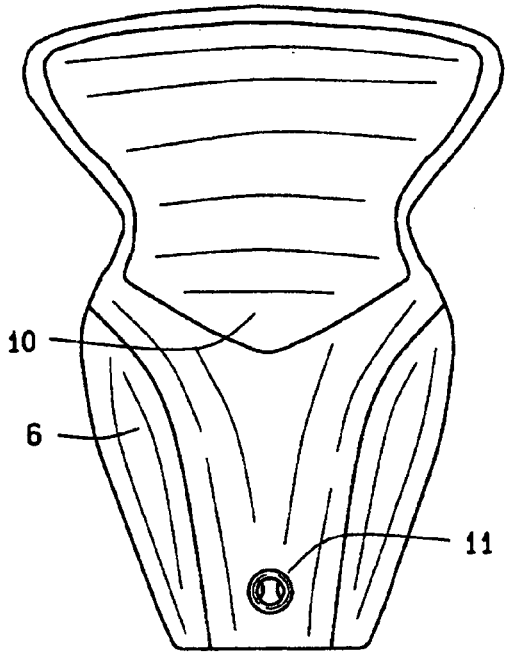
FIG. 3 is a top plan view of the reversible tongue of this invention.
Figure 4:
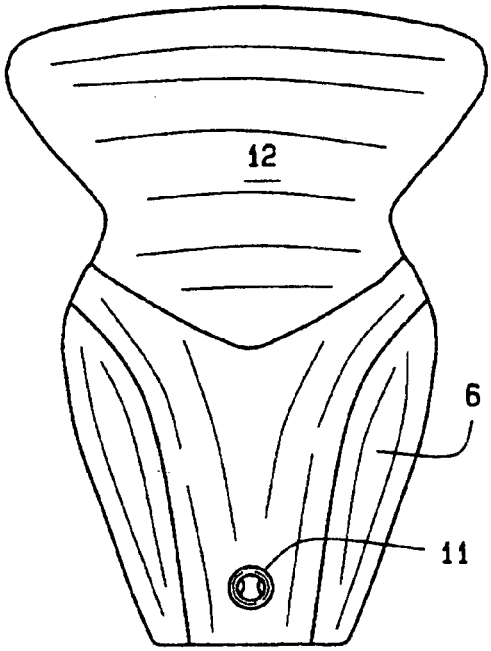
FIG. 4 is a top plan view of the opposite surface of the reversible tongue.

The tongue is reversible, and may contain some indicia, coloration or a trademark, upon it's top surface, as can been seen at 10, as noted in FIG. 3. The snap 11 that cooperates with the clasp, for holding the reversible tongue in position, is shown at the lower segment of the reversible tongue 6. In addition, the opposite side of the reversible tongue 6 can be seen in FIG. 4, and it may contain other indicia, or styling, along its surface, as may be desired by the footwear designer, or the shoe owner, as may be of interest. This can be applied to the upper portion 12 of the reversible tongue, or along its entire upper surface, as noted.

Obviously, while the preferred embodiment shows means for clasping through snaps the reversible tongue to the upper center portion of the shoe vamp, as noted in FIG. 2, it is just as likely that, instead of using a clasp 7, the reversible tongue may snap directly to the upper edge of the vamp, having a snap upon both lower surfaces of the reversible tongue, so that it can be snapped directly to the vamp, regardless which surface of the reversible tongue is desired to be arranged upwardly, simply through the efforts of the footwear owner, by releasing the tongue, reversing it, and snapping it back into a fixed position, relative to the shoe vamp. Or, the tongue might be held by other means of connection, such as by a tie means, a Velcro strip or any other means for securement, for firmly holding the tongue in place, for use in displaying whatever surface of the tongue is desired to be shown.

Figure 5:
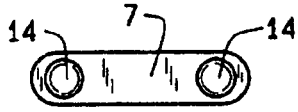
FIG. 5 is a view of the opened clasp.
Figure 6:
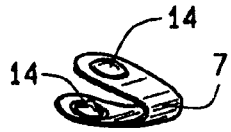
FIG. 6 shows the clasp in the process of being snapped into closure.

FIGS. 5 and 6 show one example of a type of clasp 7 that may be employed. The clasp comprises a length of flexible material, and may even be resilient, and inserts through a slot 13 provided in the upper central portion of the vamp 3, as noted. The clasp may then be folded over, and connect with the male part of the snap, that is secured approximate to the lower edges, on both sides, of the tongue 6, as can be seen at 11, and which snap into the female components of the snaps, as shown at 14, as can be seen.

Figure 7:
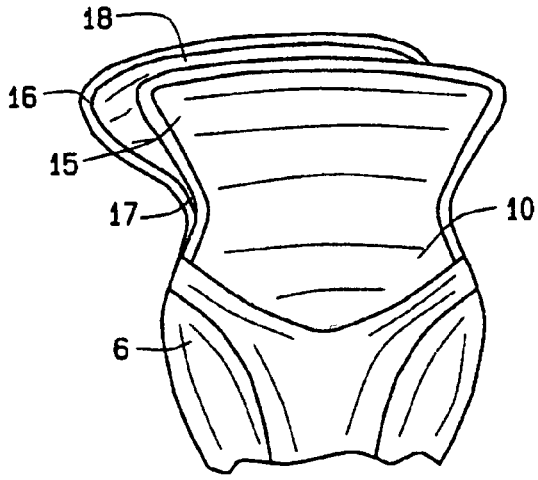
FIG. 7 shows the reversible tongue containing a pocket in its upper half, and which may be secured by Velcro, or the like, into closure.

Another feature of this invention is to furnish the reversible tongue 6 with a pocket or pouch, as can be seen in FIG. 7. The upper segment, or the entire pocket, may be formed of a pair of liners of material, such as can be seen at 15 and 16, have a spacing there between, stitched around the edges up to the proximate point of the pocket's opening, as at 17. Then, means for securing the upper peripheral edges of the pocket may be provided, such as through the use of the hook and pile fastener means 18, or Velcro, that is affixed to the upper interior edges of both of the liners 15 and 16, to furnish closure to the formed pocket.

As previously reviewed, one upper surface of the tongue 6 may include some indicia, or styling, as noted at 10, may include the display of the trademark, or other stylization, as can be noted. The opposite side, or lower side 12 of the pocket, may also be somewhat reinforced, as seen, but it may be fabricated to a different style or it may be formed, at that region, of a transparent or clear material, so that the contents of the pocket are readily observed when the tongue may be fastened to the footwear with the layer 12 comprising the upper surface of the reversible tongue, reversed in a manner as previously described. This may add to the enhanced attractiveness of the footwear, having a reversible tongue with a transparent pocket provided therein, for use for holding personal items, or the wearer may decide to put a photograph under the transparent liner, so as to allow it to be readily observable, while the shoes are worn, by the owner.

Figure 8:
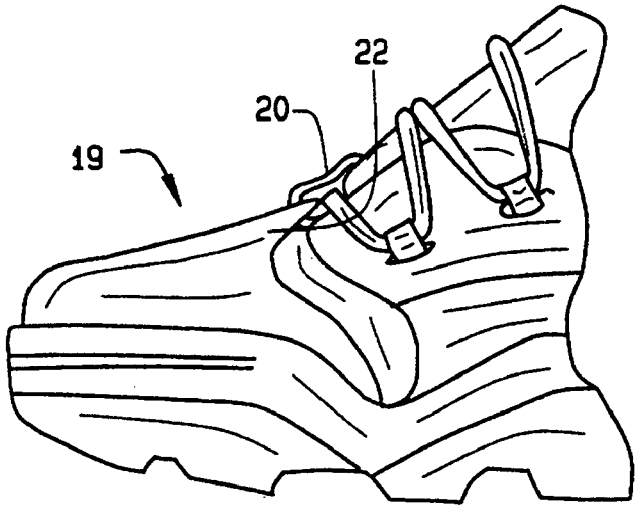
FIG. 8 is a side view of a modified more casual shoe having a different style of means for connecting the reversible tongue to the shoe vamp.
Figure 9:
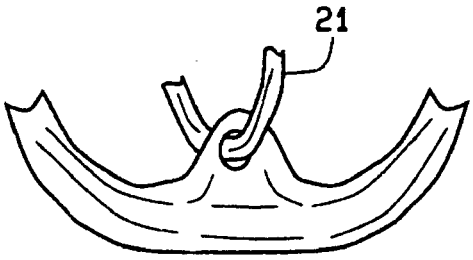
FIG. 9 shows an elastic type of clasp, which is in the form of an elastic band that can insert through the top of the vamp and either temporarily or permanently connect with the reversible tongue.
Figure 10:
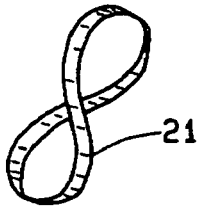
FIG. 10 shows how the elastic band may be reversed, into a figure eight configuration, for reversing its permanently held gusset or tongue in place.

FIGS. 8 through 10 each disclose another method for holding the reversible tongue in place, in this particular instance, upon a more casual type of footwear. As noted, the footwear 19 in FIG. 8, at its upper vamp portion, has an aperture 20 located therethrough. Through this aperture 20 there is located a type of clasping means, in this particular instance, a band, which may be made of a more elastomeric, resilient, or elastic material, as noted at 21. Preferably, the band, as shown in FIG. 10, may be continuous, as noted.

Thus, where it has some resiliency, or is elastic in texture, it may easily be reversed, by twisting, as noted, so that the tongue or gusset can be easily reversed, as previously described in this application, to attain the attributes of the reversing feature of this invention. Furthermore, the tongue will be permanently adhered to the vamp, so that the tongues cannot be shoplifted, or inadvertently removed, as for example, when displayed in the store, which might be done with the snap type of connection, as previously explained. Hence, this method of attachment adds more permanency to the structure of the reversible tongue when used in combination with the shown shoe. Furthermore, the upper part of the vamp, as at 22, may be slightly elevated, to extend off of the instep of a foot, so that whatever bulk is generated through the reversing of the band, in holding the tongue in place, will not bind against the foot, and add discomfort thereat. These are examples as to how the reversible tongue may be used in combination with footwear, of any style, to provide the attributes as explained herein. Where the aperture 20 is provided, there may be a grommet furnished, to prevent any tearing of the vamp at that location, and to provide longevity of usage of the shoe, and its reversible tongue, by the owner.

Figure 11:
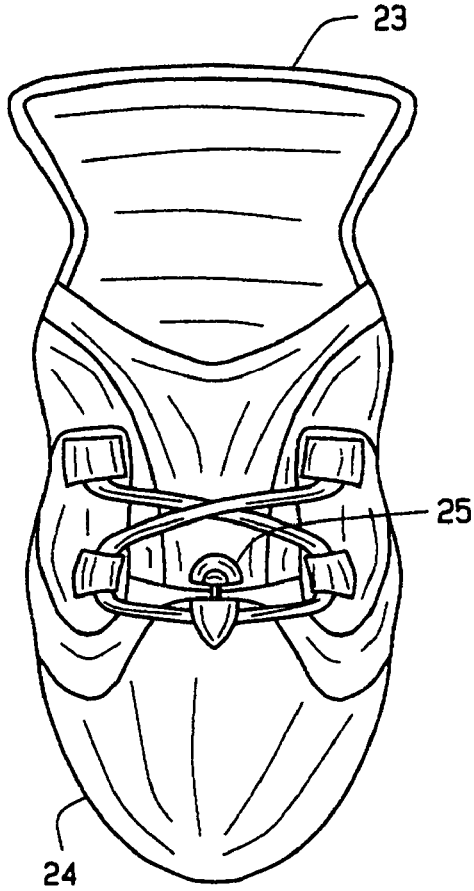
FIG. 11 is a top view of a partial shoe, showing the upper vamp, reversible tongue, ball and socket attachment holding the tongue to the footwear, and cooperating with lacing to secure the shoe upon the foot of its wearer.

As can be seen in FIG. 11, the reversible tongue 23, is attached to the vamp 24 applied by means of the ball and socket attachment 25.

Figure 12:
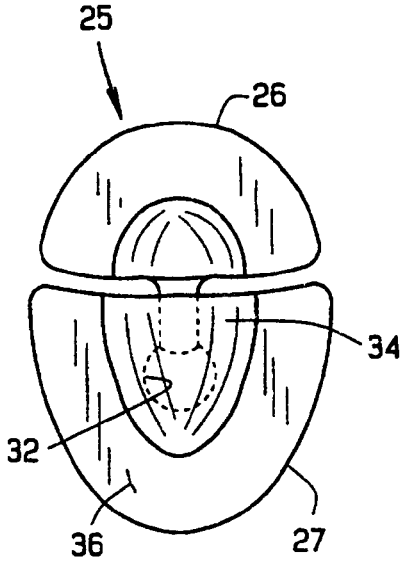
FIG. 12 is a top plan view of the ball and socket attachment according to the preferred embodiment.
Figure 13:
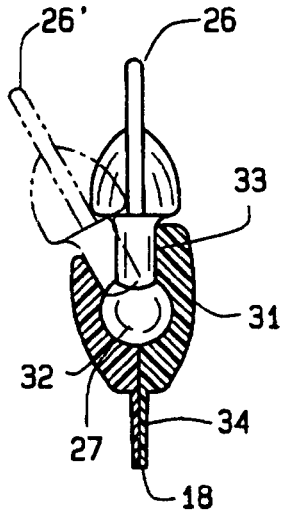
FIG. 13 is a side partially sectional view of the ball and socket attachment according to the preferred embodiment.

In referring to FIGS. 12 and 13, the ball and socket attachment 25 comprises a ball portion 26, and a socket portion 27 attached to the vamp 24, as previously shown. This provides a swivel connection for a preferred embodiment. The ball portion 26 is preferably both movable between a position shown by said ball portion, and a position shown by the ball portion 26' in phantom, and rotatable within the socket portion 27, as can be understood.

As a result, the tongue 23 is fully rotatable about an axis A, as noted, and restricted rotation or pivot about the axis B perpendicular to the plane of FIG. 13, as through an angle C, and therefore orients the gusset generally in its upright position, but frees it sufficiently forwardly, to pivot or rotate, as desired by the user.

The axis B can be described as roughly perpendicular to the axis A. The ball portion 26 is preferably made from a resilient polymeric material. In addition, as previously explained, it may be desired to provide a basis for separation of the ball portion, from within the socket, when the user desires to change gussets, and that force can be either minimal, or perhaps even at a high strength, so that during shipment, storage, or display upon the market, the gussets cannot be too easily removed, by unauthorized persons, until such time as the pair of shoes are sold.

Figure 14:
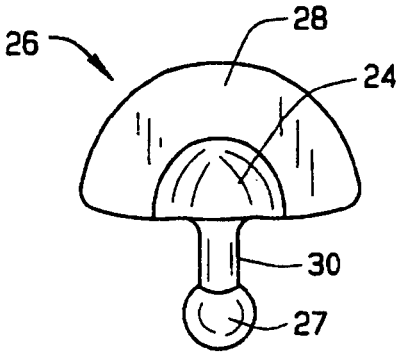
FIG. 14 is a front view of a ball portion according to the preferred embodiment.

In referring to FIG. 14, the ball portion 26 comprises the ball 27, as shown, a flat attachment portion 28 and a rounded attachment portion 29, as noted. The rounded attachment portion 29 is attached to the ball 27 by a generally cylindrical neck portion 30. The tongue 23 may be either a singular or laminar piece of material, made from a fabric, a polymer, or leather, or the like. The flat attachment portion 28 is attached to the tongue by an adhesive, by sewing, or otherwise attaching the flat attachment portion 28 to the tongue 23, by any means known in the art. If the tongue 23 is a laminar piece, that flat attachment portion 28 of the ball portion 26 is preferably attached to the tongue between the laminar layers to minimize visibility. The preferred method of attachment differs depending upon the material of the tongue 23.

Referring back to FIGS. 12 and 13, the socket portion 27 preferably comprises a socket 31. The top portion of the socket is defined by a cavity 32 at the bottom of the slot 33 for accepting the ball 27, as can be noted. The bottom portion 27, of the socket, includes flat attachment extensions 34 that are used to attach the top and bottom portions, of the entire clasp, or swivel, to the vamp 24 of the shoe. Similar to the tongue or gusset 23, the vamp may be either a singular or laminar piece of material made from a fabric, a polymer, or leather, or the like. The portions 34 and 28 may be attached to the vamp 24 in a similar manner as the ball portion 26 is attached to the tongue or gusset 23, as explained.

The upper portion 31 of the socket, in defining its bore 32, has some element of flexibility, that allows the ball portion 26, and more specifically its ball 27, to be moved into or out of the socket, as can be understood. In addition, since the upper portion 31 of the socket portion has that angular opened relationship, as shown by the angle C, the ball portion 26 can be moved into the various positions, forwardly of the shoe, to allow the reversible tongue to be pivoted slightly forwardly, to facilitate is reversal when manipulated in the manner as described herein.

Figure 15:
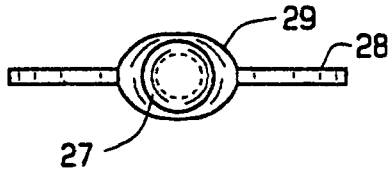
FIG. 15 is a bottom view of a ball portion according to the preferred embodiment.
Figure 16:
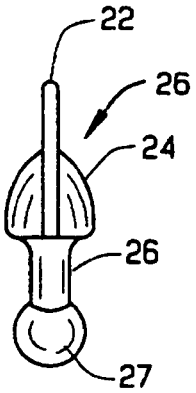
FIG. 16 is a right side view of socket ball portion according to the preferred embodiment.

In addition, the diameter of the bore may be selected such that the ball 27 may be forcibly removed from its socket 27, by resiliently deflecting the top part 31 or 35 of the socket, as can be noted. Alternatively, it can be provided that the ball 27 is not removable from the bore 32. In this instance, it can be seen that the socket 27 may be formed of two halves, one comprising the top part 35, and the back part 36, which may be adhesively or otherwise secured together, to form a permanent socket 27, as noted. Thus, to provide for a permanent mount of the ball 27 within the socket bore 32, the ball 27 must be placed within the socket 32 before the top and bottom parts 35 and 36 are attached to one another. Or, as previously explained, there may be some slight resiliency in the upper part 35, to allow the ball 27 to be forcibly removed from the socket, when it is desired to separate the tongue or gusset from the shoe, as noted. In either instance, it is preferred that the ball 27, and hence the tongue 23, have sufficient clearance to allow for the tongue to be rotatable by means of its ball 27 within the socket bore 32, in order to expose a second side of the tongue 23, as can be understood. In this manner, the tongue 23 may have first and second sides, of differing color, material, designs, and/or displaying indicia, and may be alternatively displayed by the user by mere rotation of the tongue 12, in the spirit of this invention. See also FIGS. 15 and 16.

It is further just as likely that the ball and socket connection could be replaced with a bayonet style of locking device. For example, with a bayonet style of swivel locking device, the tongue may be pivoted in one direction, to expose its upper surface from above the shoe, or it may be pivoted in a 180° degree direction, to expose the bottom portion of the shoe-tongue. But, at the mid point or 90° degree turn, a stem extending off of the ball portion may obtain clearance from the socket for removal of the top part of the bayonet lock, and the tongue, from the vamp and socket. Or, one of those bead style of ball and socket connectors, such as currently available for use in the construction of a necklace, bracelet, or the like, could be adapted for use for swively connecting the tongue or gusset to the vamp portion of the footwear.

Figure 17:
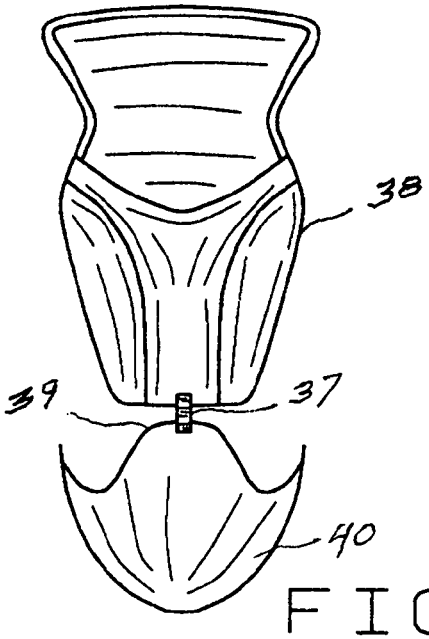
FIG. 17 is a top view of the partial shoe, showing the upper vamp, reversible tongue, and a link holding the tongue or gusset to the footwear, for providing the reversible feature.

The concept of this invention may be generally paraphrased by reviewing FIG. 17. Essentially, the essence of the invention is to provide some linking means, as at 37, that holds the tongue 38 to the upper portion 39 of the shoe vamp 40. Hence, that linking means may be any one of the swivels, and elastic cord, a flexible rubber or polymer, or an elastic means, that allows the tongue to be reversed in its setting.

And, as previously explained, the concept of the invention is to also provide, when a swivel is used, one that may possibly be separable, so that the tongue can actually be removed, and replaced with a substitute gusset, for adding further design and coloration to the footwear, when worn.

Obviously, the reversible tongue can be formed of a variety of materials, whether it be fabric, polymer, leather, transparent acrylic or polyethylene, any as such materials which add to the attractiveness of the shoe, but at the same time, provide reasonable strength and sturdiness to withstand the constant and repeat usage.

Figure 18:
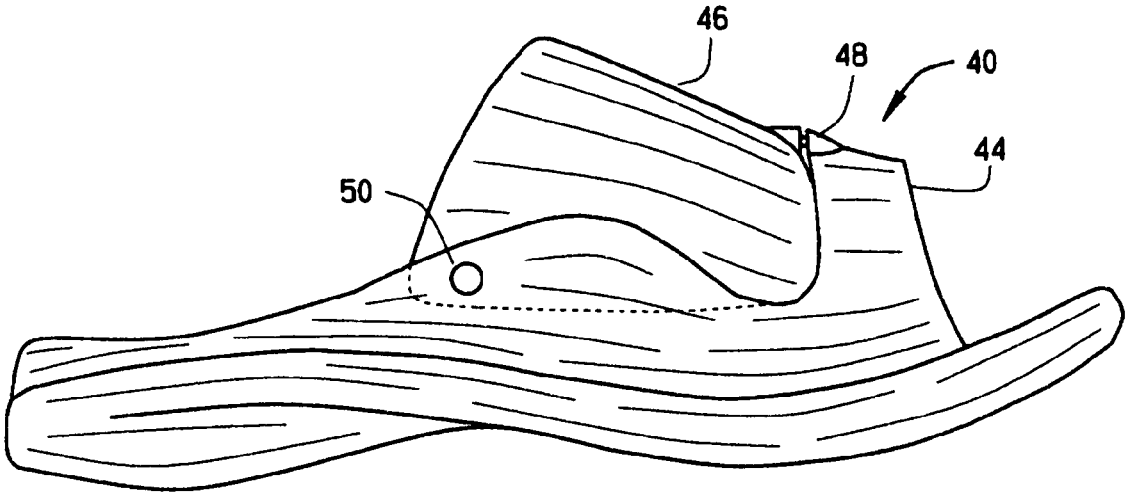
FIG. 18 is a side view of an open-toed sandal implementing a reversible tongue according to the present invention.

Referring to FIG. 18, there is shown a variation of the present concept of a reversible tongue as implemented in a sandal 40. The sandal 40 comprises a sole portion 42, a vamp portion 44 and a tongue portion 46. The tongue portion 46 is attached to the vamp portion 44 by a retaining means 48, described above. The tongue portion 46 is further removably attached to the vamp portion 44, such as by a snap 50. However, the present invention is not limited by a snap and other types of known attachment devices could be implemented, such as a hook and look material attached to the tongue portion 46 and the vamp portion 44.

Figure 19:
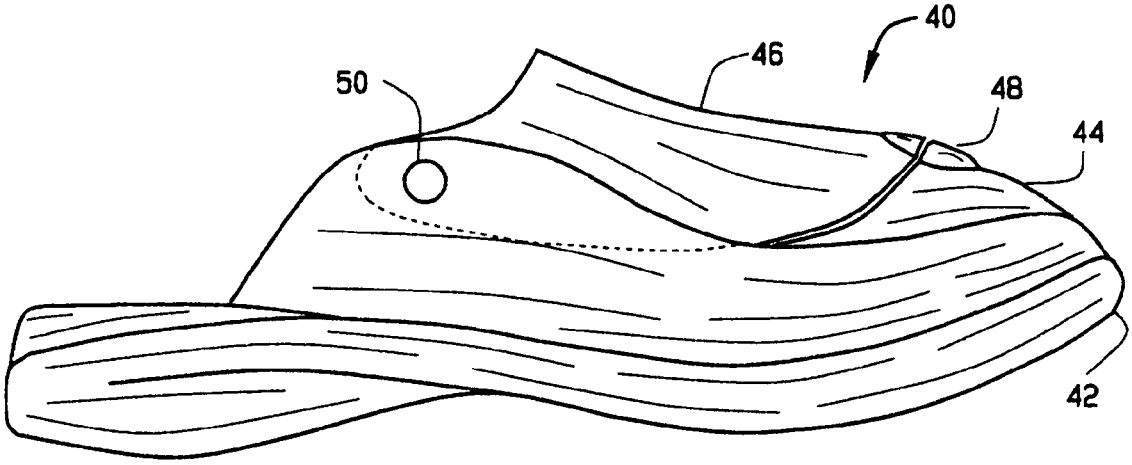
FIG. 19 is a side view of a closed-toed sandal implementing a reversible tongue according to the present invention.

The sandal of FIG. 19 is similar in most respects to the sandal of FIG. 18 except that the vamp portion 44 is enlarged to cover the toes of a wearer to resemble a clog-type shoe. In the configuration of FIG. 19, the vamp portion 46 is preferable sized to allow a larger amount of the tongue portion 46 to be visible.

Figure 20:
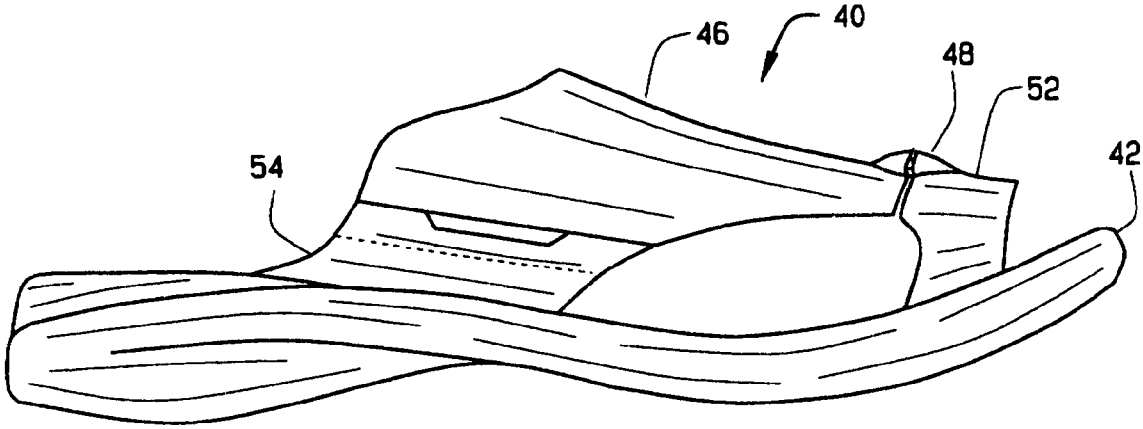
FIG. 20 is a side view of an open-toed sandal implementing a reversible tongue according to the present invention wherein the vamp portion surrounds only a single toe of the wearer.

The sandal of FIG. 20 is similar in many respects to the sandal of FIG. 18 except that the vamp portion 44 comprises three separate portions namely a front vamp portion 52 and two side vamp portions 54. The front vamp portion 52 is large enough only to cover the big toe of the wearer. The side vamp portion extends from the sole 42 in order to attach to the tongue portion 46. Additionally, the shoe of FIG. 20 implements a hook and loop attachment as described above with respect to FIG. 18 in order to attach the tongue portion 46 to the vamp portion 44, although as discussed above, other known attachment methods can be used.

Obviously, the style of sandal as shown herein could just as easily be modified, and constructed, for use for domestic purposes, such as for use as a slipper, or the like, around the household.

Figure 21:
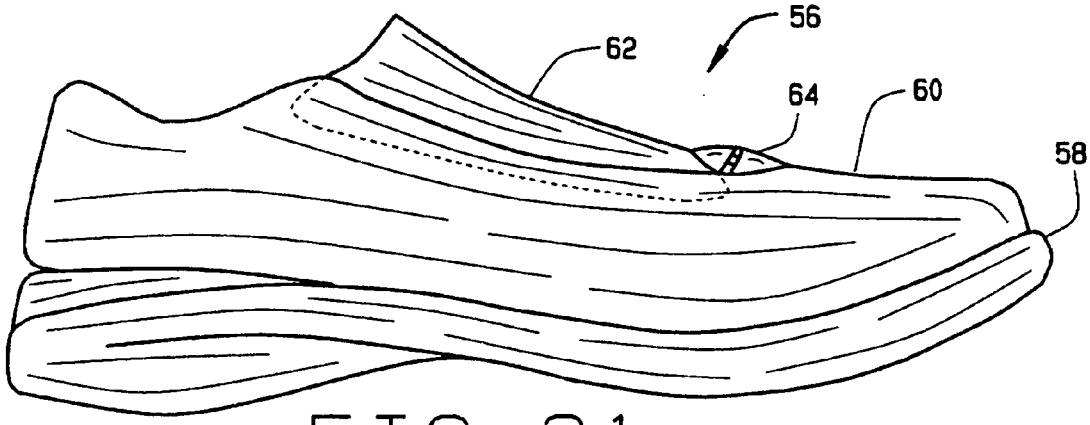
FIG. 21 is a side view of a shoe implementing a reversible tongue according to the present invention wherein the tongue is made from a stretchable material to eliminate the need for shoestrings.
Figure 22:
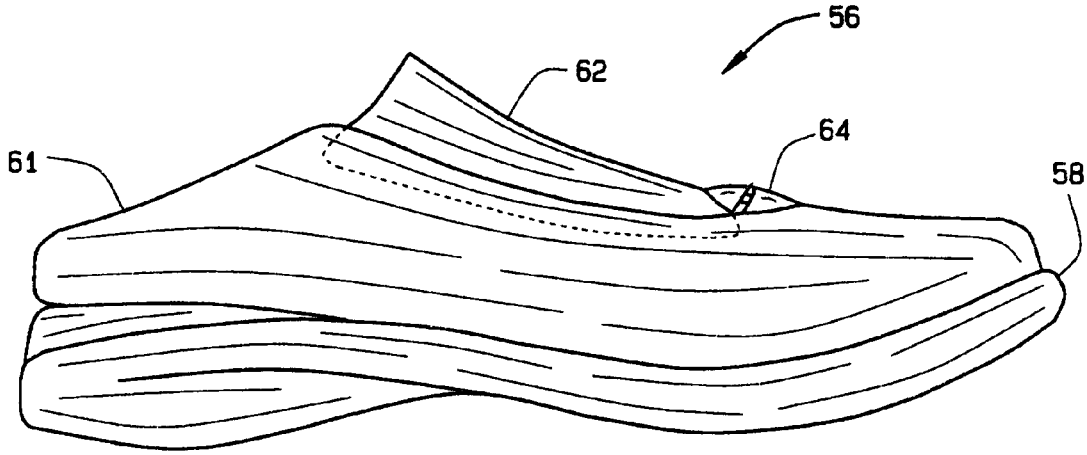
FIG. 22 is a side view of a shoe implementing a reversible tongue according to the present invention wherein the tongue is made from a stretchable material to eliminate the need for shoestrings and having a lower cut clog-type back portion.

In FIG. 21, there is shown a slip-on type shoe 56 implementing a sole 58, a vamp 60, a tongue 62 and a retaining means 64, as described above. The tongue 62 is made from known stretchable or resilient type material and is attached by hook and loop type material to the vamp 60 where the vamp 60 and tongue 62 overlap. When the wearer wears the shoe of FIG. 21, the stretchable tongue will stretch to provide a tight fit of the shoe to maintain it on the foot of the wearer. In FIG. 22, there is shown a slip-on type shoe 56 as in FIG. 21 that implements a low-rise heel 61.

Figure 23:
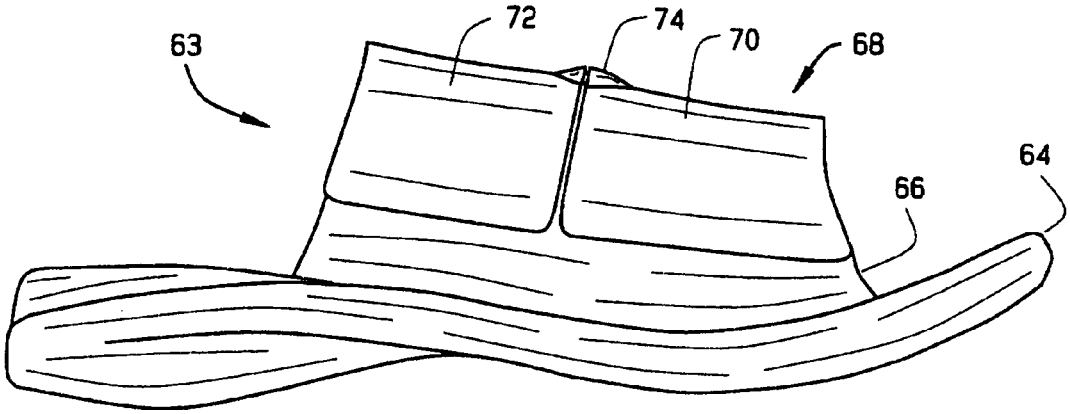
FIG. 23 is a side view of a sandal implementing a reversible double tongue according to the present invention wherein such that four possible color combinations can be shown on a single sandal.

In FIG. 23, a sandal 63 is shown that has a sole portion 64 and a vamp portion 66. What is referred to as the tongue portion 68, although it does not fulfill the traditional purpose of a tongue, is attached to the vamp 66 with hook and loop material, snaps or the other known attachment methods.

The tongue portion 68 is made of a front tongue portion 70 and a rear tongue portion 72 attached by a retaining means 74, described above. The tongue portion 68 may be completely removed from the vamp 66.

Figure 24:
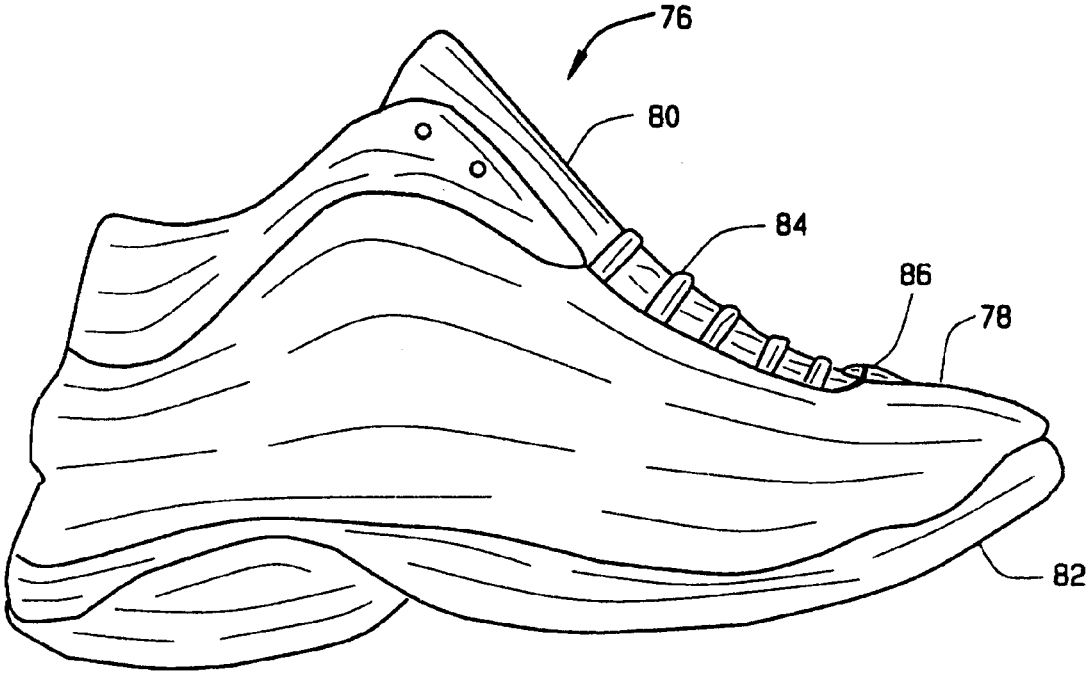
FIG. 24 is a side view of a shoe implementing a reversible tongue according to the present invention wherein the vamp portion of the ball and socket attachment is enlarged to cover or constitute an extended portion of the vamp.

In FIG. 24, there is shown an athletic-type shoe 76 having a vamp 78, tongue 80 and a sole 82. The tongue 80 is maintained in position, and the shoe held to the wearer, by shoelaces 84. The tongue 80 is further attached to the vamp 78 by a retaining means 86, described above, allowing the tongue 80 to be rotatably attached to the vamp 78 to display alternate sides of the tongue 80.

The type of athletic shoes that can utilize the subject matter of this invention includes football shoes, soccer shoes, track shoes, baseball shoes, and any other type of athletic shoe for which a tongue portion is provided, and is capable of being reversed in its application.

Obviously, shoes of the foregoing category may also include boots that may be used for hiking, work, or for any other variety of purposes for which footwear of this type is employed. For example, one surface of the hunting or hiking boots may have an attractive appearance to it, while the opposite surface may be waterproofed, to facilitate their usage when walking through moist or rain laden areas, such as while hunting or fishing.

Figure 25:
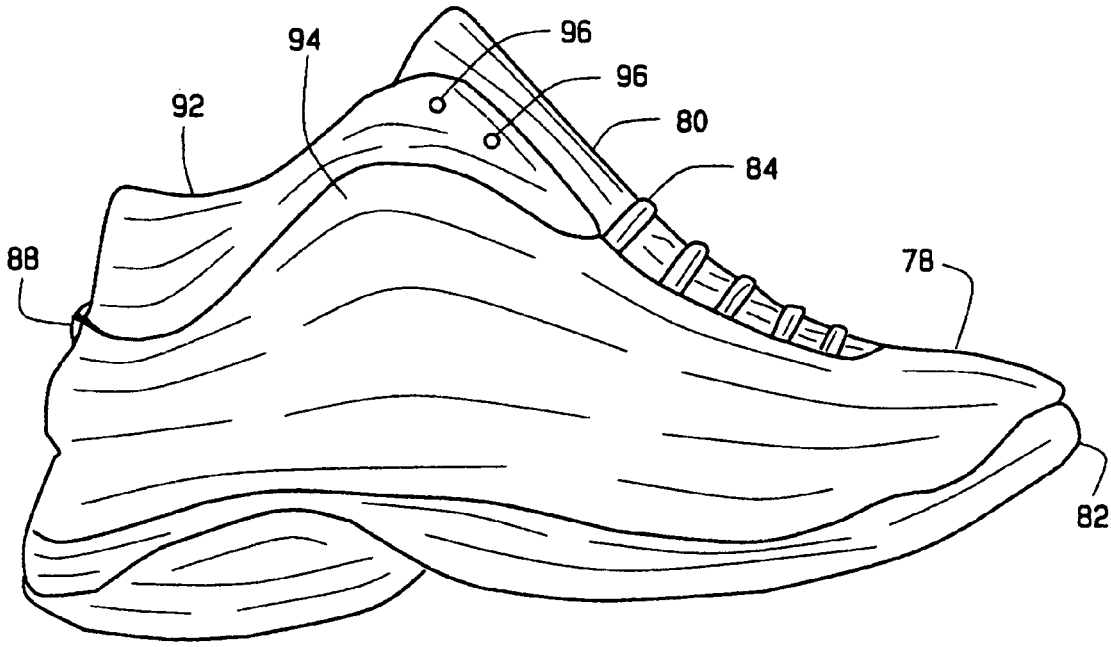
FIG. 25 is a side view of a shoe implementing a reversible collar portion attached to the shoe upper according to the present invention.

In FIG. 25, the shoe 76 of FIG. 24 is shown with the tongue 80 directly attached to the vamp 78, but having a retaining means 88 attached to an upper portion 90 of the shoe 76 and a collar portion 92 of the shoe 76. The collar portion 92 is also preferably attached to the shoe upper 94 by hook and loop material, snaps or another known attachment method.

In this manner, the shoe collar 92 can have different colors and/or designs on opposite sides thereof. When the wearer wishes to display a particular side of the collar 92, the wearer unattaches the hook and loop material, rotates the collar 92 180 degrees with respect to the shoe upper 94, and re-shapes the resilient collar so that it may be reattached via the hook and loop material.

It will be readily recognized by one of ordinary skill in the art that a shoe may be constructed having both the tongue 80 attached to the vamp 78 by a retaining means 86 and the collar 92 attached to the shoe upper 94 by a retaining means 88 on a single shoe. While the shoe of FIG. 25 has been described as attaching the collar 92 to the shoe upper 94 with hook and loop material or other known attachment methods, it should be recognized that collar 92 the could be left unattached to the upper except through the retaining means 88 and instead maintained in position by the shoelaces that thread through both the upper 94 or vamp 78 and through shoelace holes 96 within the collar 92.

Figure 26:
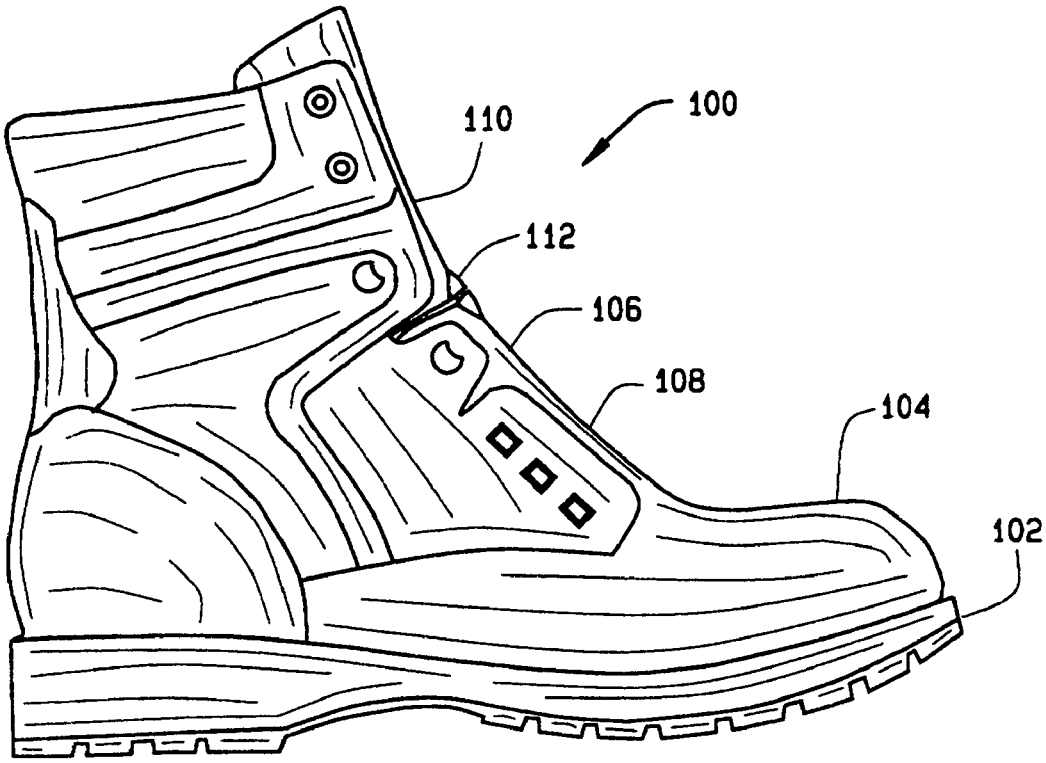
FIG. 26 is a side view of a boot implementing a reversible upper tongue portion according to the present invention.

In FIG. 26, there is shown a boot 100 having a sole 102, a vamp 104 and a segmented tongue 106. The segmented tongue 106 comprises a first, upper portion 110 and a second, lower portion 108. The upper portion 110 is attached to the lower portion 108 by a retaining means 112, described above. The retaining means 112 allows the upper portion 108 of the tongue 106 to be rotated with respect to the lower portion 108 without unattachment from the lower portion 108 to display alternate sides of the upper portion 110 of the tongue 106.

Figure 27:
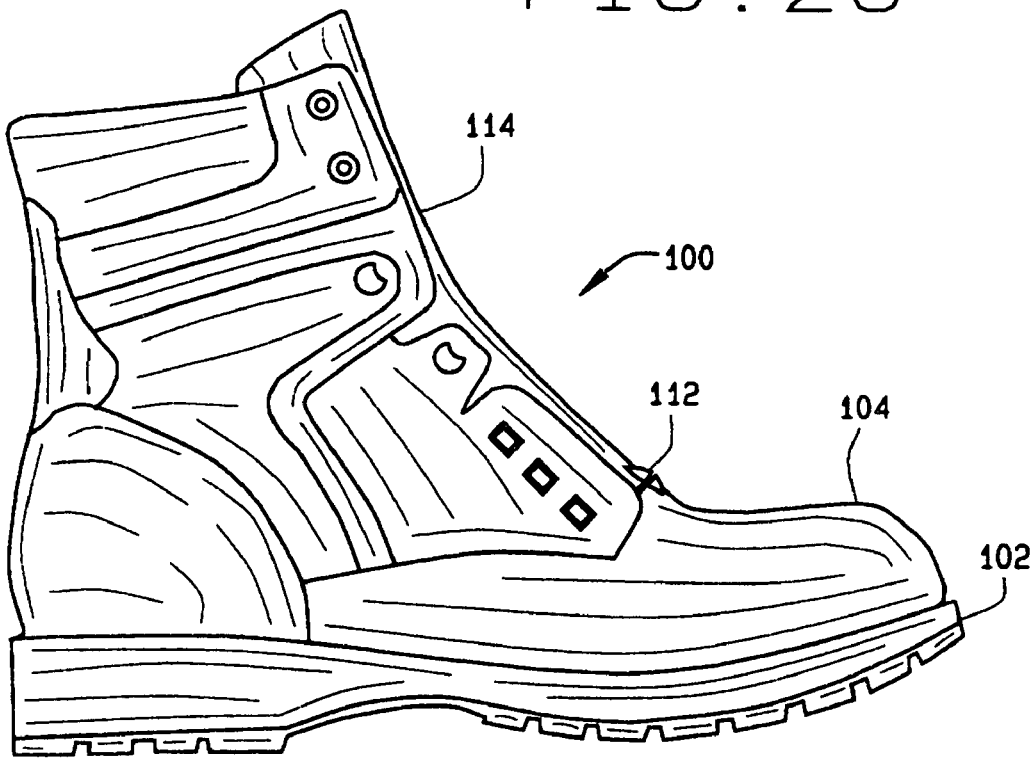
FIG. 27 is a side view of a boot implementing a reversible tongue according to the present invention.

In FIG. 27, the boot of FIG. 26 is shown without a segmented tongue 106 but a single one-piece tongue 114 attached to the vamp 104 with the retaining means 112 such that instead of alternating displaying only the upper portion 110 of the tongue 106, the wearer may alternately display opposing sides of the entire tongue 114. It will be readily appreciated by those of ordinary skill in the art that a boot or shoe could combine the features of FIGS. 26 and 27 to provide a boot or shoe with a segmented tongue and two retaining means whereby both the upper and lower portions of the tongue can be selectively rotated and outwardly displayed.

It is further likely that from viewing the embodiments for the invention as shown in FIGS. 26 and 27, that the tongue or gusset could be formed as two or more components.

For example, there may be the upper portion 110; the lower portion 108, of the segmented tongue, and the portion 108 may be formed in a manner similar to FIG. 27, where there may be a second retaining or swivel means 112, at the bottom of the lower portion 108, as disclosed therein. Thus, the tongue may be pivoted twice, both at its upper portion, and the lower portion, to reveal their back sides, as may be desired.

Figure 28:
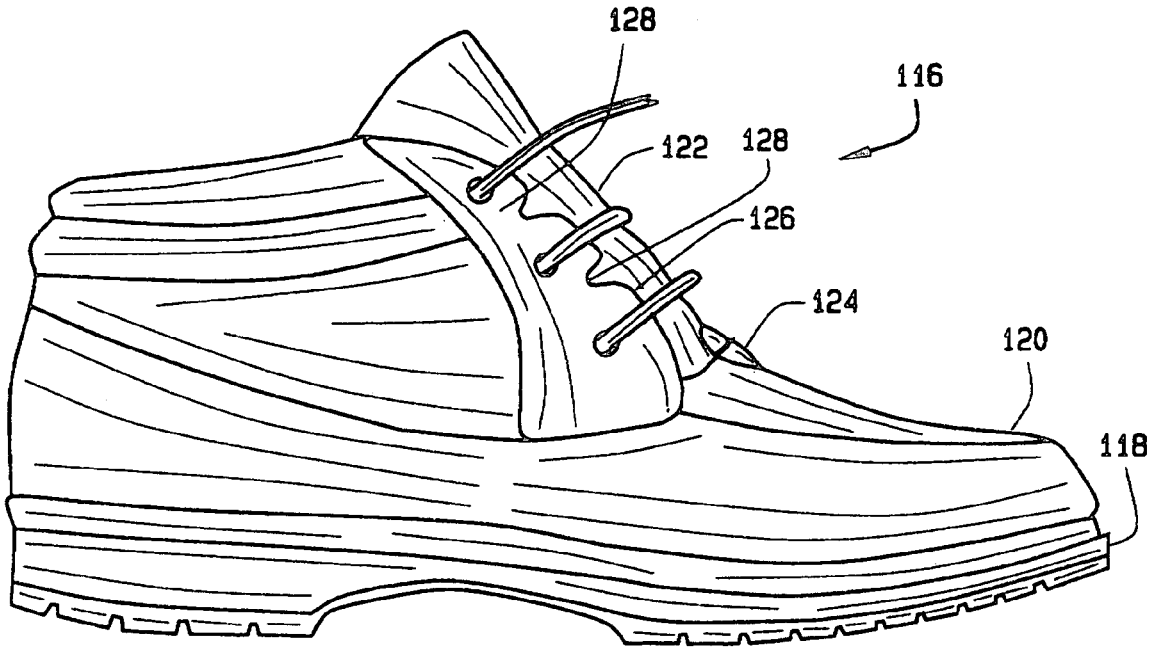
FIG. 28 is a side view of a shoe implementing a reversible tongue wherein the eyelets have implemented scalloping in order to shoe more surface of the tongue according to the present invention.

The concept of a reversible tongue that does not require the tongue to be removed from the shoe in order to be reversed can similarly be applied to dress-type shoes. In FIG. 28, there is provides a dress-type shoe 116 with a sole 118, a vamp 120 and a tongue 122. The tongue 122 rotateably attached to the vamp 120 by a retaining means 124 described above. As above, the retaining means 124 allows alternate sides of the tongue to be displayed.

In the case of the present dress-type shoe 116, the tongue 122 may be colored or styled upon its alternate sides to change the character of the shoe from a more formal shoe to a more casual shoe at the desire of the wearer. The tongue 122 may or may not be further attached to an upper 126 of the shoe 116 by hook and loop material or other known attachment methods. Furthermore, the upper of the shoe 116 is provided with scalloping 128 in order to display more of the tongue 122.

Figure 29:
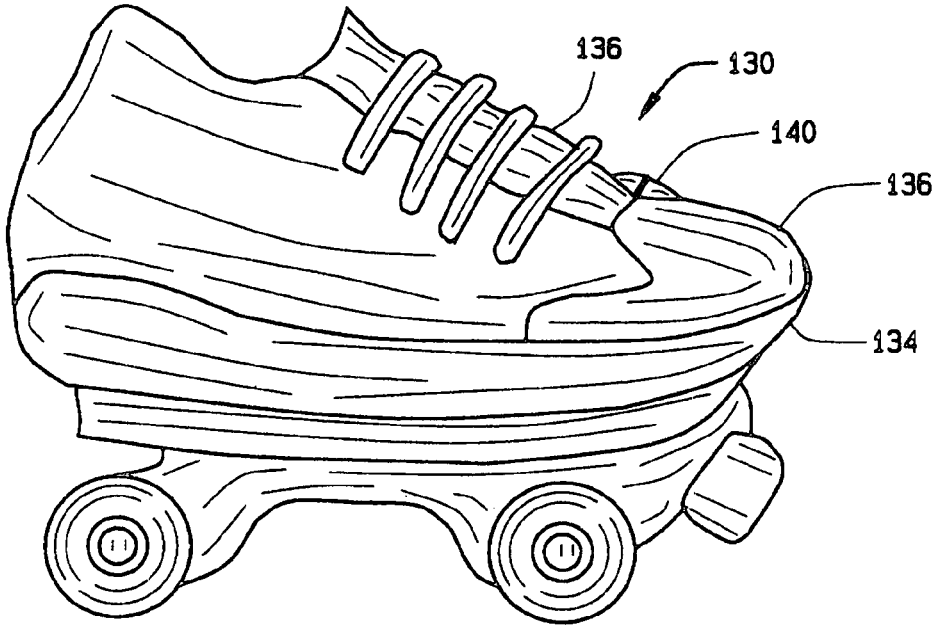
FIG. 29 is a side view of a roller skate implementing a reversible tongue according to the present invention.
Figure 30:
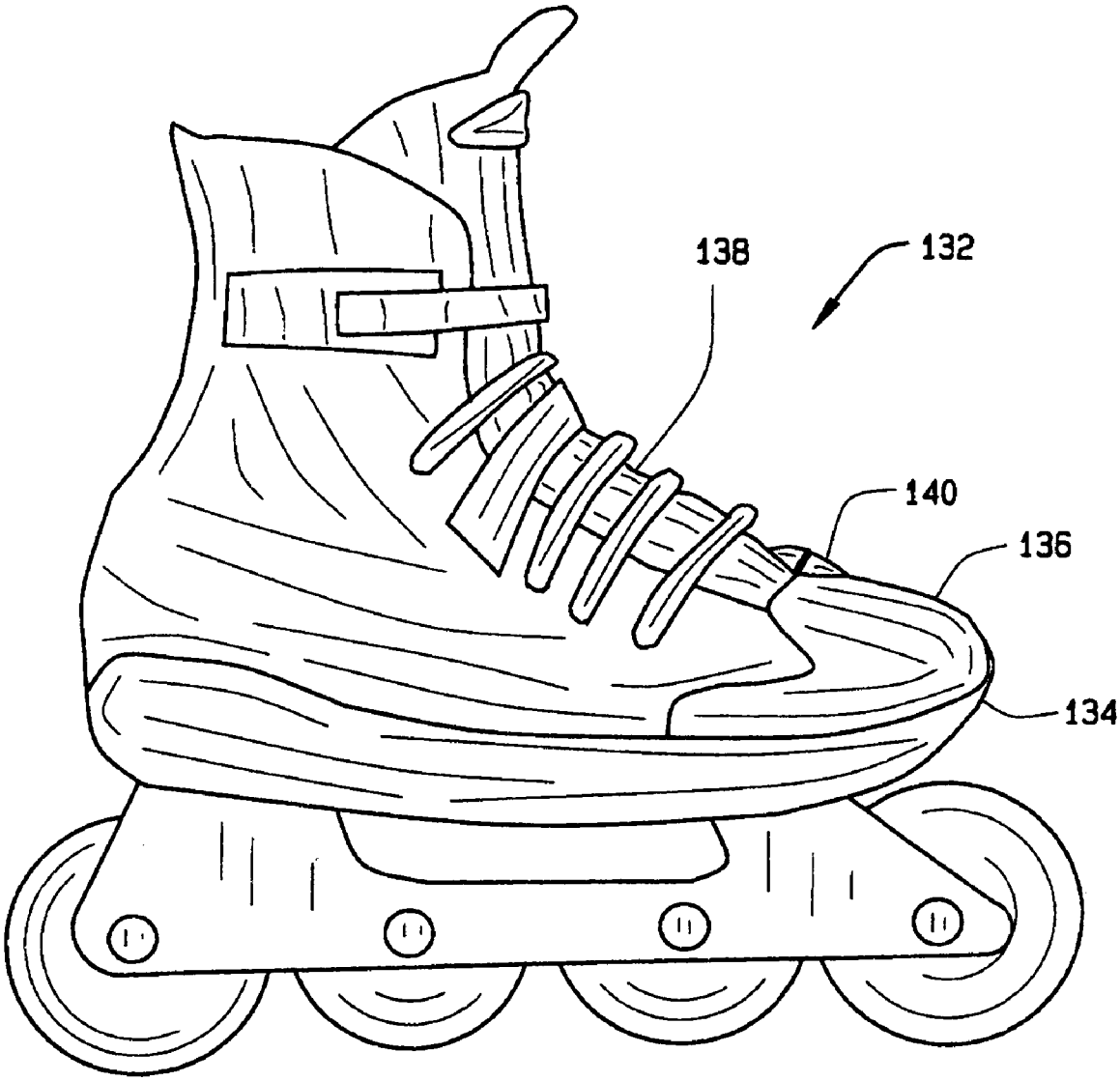
FIG. 30 is a side view of an inline skate implementing a reversible tongue according to the present invention.

In FIGS. 29 and 30, there are providing a roller skate 130 and an inline skate 132, respectively. The skates each have a wheeled base portion 134, a vamp 136 that is typically made from a hard plastic material, and a tongue 138 attached to the vamp 136 by a retaining means 140, describe above. In the same manner as before, the retaining means 140 allows the tongue 138 to be rotated to alternately display opposite sides of the tongue 138 without removal of the tongue 138 from the skate.

Variations or modifications to the subject matter of this invention may occur to those skilled in the art upon reviewing the disclosure as provided therein. Such variations, within the spirit of this development, are intended to be encompassed within the scope of any invention as provided herein.

The description of the preferred embodiment as set forth herein is done so for illustrative purposes only.

The invention claimed is:

1. A shoe comprising a sole, a vamp and a tongue portion wherein the tongue portion is attached to the vamp by a linking means that allows the tongue portion to be rotated with respect to the vamp to display alternating sides of the tongue portion, said linking means tapering to a flat attachment upon said tongue portion and said vamp, and said linking means including a ball and socket.

2. The shoe of claim 1 wherein the tongue comprises a first tongue portion and a second tongue portion wherein each tongue portion is attached to the vamp with a retaining means, whereby each tongue portion may be individually rotated with respect to the vamp to alternately display opposing sides of each tongue.

3. The shoe of claim 1 wherein the shoe further comprises a roller skate.

4. The shoe of claim 1 wherein the shoe further comprises an inline skate.

5. The shoe of claim 1 wherein said shoe is a sandal.

6. The sandal of claim 5 wherein the tongue portion can be rotated with respect to the vamp without removal of the tongue portion from the vamp portion.

7. The sandal of claim 5 wherein the sandal is an open-toed sandal.

8. The sandal of claim 5 wherein the vamp is configured to cover at least the big toe of the wearer.

9. The sandal of claim 5 wherein the tongue portion is further removably attachable to the vamp.

10. The sandal of claim 5 wherein the tongue portion is further removably attachable to the vamp with hook and loop material.

11. The sandal of claim 5 wherein the tongue is made of a stretchable, resilient material that provides a tight fit on the foot of the wearer.

* * * * *